US008272219B1

(12) United States Patent
Johnson et al.

(10) Patent No.: US 8,272,219 B1
(45) Date of Patent: Sep. 25, 2012

(54) GAS TURBINE ENGINE COMBUSTOR HAVING TRAPPED DUAL VORTEX CAVITY

(75) Inventors: Arthur Wesley Johnson, Cincinnati, OH (US); David Louis Burrus, Cincinnati, OH (US)

(73) Assignee: General Electric Company, Cincinnati, OH (US)

( * ) Notice: Subject to any disclaimer, the term of this patent is extended or adjusted under 35 U.S.C. 154(b) by 3624 days.

(21) Appl. No.: 09/706,427

(22) Filed: Nov. 3, 2000

(51) Int. Cl.
*F02C 7/00* (2006.01)

(52) U.S. Cl. ..... 60/746; 60/750; 60/751

(58) Field of Classification Search ..... 60/39.36, 60/732, 746, 749, 750, 751
See application file for complete search history.

(56) References Cited

U.S. PATENT DOCUMENTS 4,187,674 A * 2/1980 Richardson ..... 60/743
5,619,855 A 4/1997 Burrus
5,791,148 A 8/1998 Burrus
5,857,339 A 1/1999 Roquemore et al.
6,286,317 B1 * 9/2001 Burrus et al. ..... 60/750
6,295,801 B1 * 10/2001 Burrus et al. ..... 60/737
6,334,298 B1 * 1/2002 Aicholtz ..... 60/750

FOREIGN PATENT DOCUMENTS

GB 2099978 A 12/1982

* cited by examiner

*Primary Examiner* — Stephen M Johnson
(74) *Attorney, Agent, or Firm* — General Electric Company; David J. Clement; William Scott Andes

(57) ABSTRACT

A gas turbine engine combuslor has a trapped dual vortex cavity defined between aft, forward, and bottom walls. Air injection first holes are positioned in the forward wall. Air injection second holes are positioned in the aft walls. Fuel injection holes in the forward wall are located between the bottom wall and a cavity opening located at a top of the cavity. First angled film cooling apertures are disposed through the bottom wall. Second angled film cooling apertures are located in the forward wall between the fuel injection holes and the bottom wall. Third angled film cooling apertures are located in the forward wall between the fuel injection holes and the cavity opening.

23 Claims, 7 Drawing Sheets

GAS TURBINE ENGINE COMBUSTOR HAVING TRAPPED DUAL VORTEX CAVITY

The Government has rights to this invention pursuant to Contract No. F33615-93-C-2305 awarded by the United States Air Force.

BACKGROUND OF THE INVENTION

The present invention relates to a gas turbine engine combustor having at least one trapped vortex cavity and, more particularly, to a combustor having cavity with dual counter-rotating vortices.

Advanced aircraft gas turbine engine technology requirements are driving the combustors therein to be shorter in length, have higher performance levels over wider operating ranges, and produce lower exhaust pollutant emission levels. One example of a combustor designed to achieve these objectives is disclosed in U.S. Pat. No. 5,619,855 to Burrus. The Burrus combustor is designed to operate efficiently at inlet air flows having a high subsonic Mach Number. This stems in part from a dome inlet module which allows air to flow freely from an upstream compressor to the combustion chamber with fuel being injected into the flow passage. The combustor also has inner and outer liners attached to the dome inlet module, which include upstream cavity portions for creating a trapped vortex of fuel and air therein, as well as downstream portions extending to the turbine nozzle. U.S. Pat. Nos. 5,791,148 and 5,857,339 also disclose the use of trapped vortex cavities in combustor liners. Fuel is injected into the trapped vortex cavities through a portion of the liner forming an aft wall of such cavity. Fuel is also injected into the flow passages of the dome inlet module via atomizers. It is desirable to have a combustion chamber, such as the one in Burrus, with better flame stabilization and flame propagation and which improves the combustor's performance characteristics of combustors, efficiency, NOx and CO emissions, and altitude-relight.

BRIEF SUMMARY OF THE INVENTION

A gas turbine engine combustor trapped dual vortex cavity is defined between an aft wall, a forward wall, a bottom wall formed therebetween. A cavity opening is located at a top of the cavity, is spaced apart from the bottom wall and extends between the aft wall and the forward wall. Air injection first holes in the forward wall are positioned close to the bottom wall, air injection second holes in the aft wall are positioned approximately midway between the bottom wall and the opening. Fuel injection holes in the forward wall are located between the air injection second holes and the bottom wall.

Features of more particular embodiments of the invention include the following. First angled film cooling apertures are disposed through the bottom wall and angled away from the forward wall. Second angled film cooling apertures are located in the forward wall 46 between the fuel injection holes and the bottom wall and angled towards the bottom wall. Third angled film cooling apertures are located in the forward wall between the fuel injection holes and the opening and angled towards the opening. Top and bottom film cooling slots are disposed parallel to the aft wall and operable to flow and direct cooling air along the aft wall. In the exemplary embodiment of the invention, the fuel injection holes, air injection first holes, and air injection second holes, are singularly arranged in circumferential rows.

An alternative embodiment does not use the bottom film cooling slot and has fourth angled film cooling apertures located between the air injection second holes in the aft wall and the bottom wall angled towards opening. A bottom wall cooling slot extends from the forward wall parallel to the bottom wall and is operable to direct and flow cooling air along the bottom wall.

The trapped dual vortex cavity is designed for use in a gas turbine engine combustor liner having a shell having the trapped dual vortex cavity formed therein. A gas turbine engine combustor having spaced apart outer and inner liners defining a combustion chamber therebetween can use trapped dual vortex outer and inner cavities and in the inner and outer liners, respectively. A dome inlet module in flow communication with the compressed air flow includes an outer member fixed to the outer liner and an inner member fixed to the inner liner such that a flow passage is defined therebetween for an air stream to flow to the combustion chamber. A plurality of fuel injector bars are positioned circumferentially around and interfacing with the inlet dome module for injecting fuel into the flow passages. Each of the fuel injector bars are in flow communication with a fuel supply and include a body portion having an upstream end, a downstream end, and a pair of sides. A first plurality of injectors located in the body portion are in flow communication with the fuel supply. Radially outer and inner fuel injectors are located in the body downstream end, are in flow communication with the fuel supply, and are aligned and open to the outer and inner plurality of fuel injection holes, respectively, in the trapped dual vortex outer and inner cavities.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
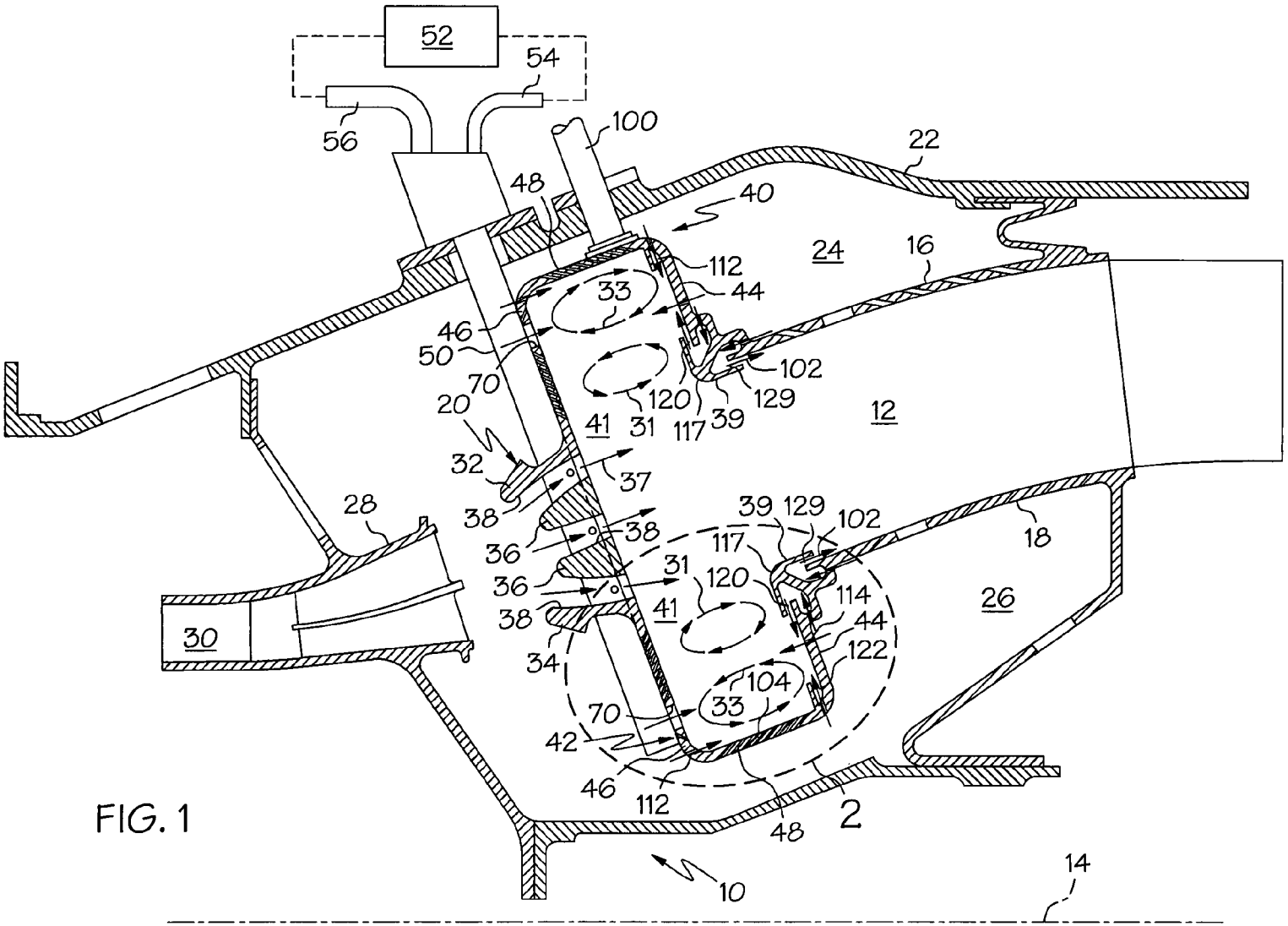
FIG. 1 is a longitudinal cross-sectional view illustration of a gas turbine engine combustor having a fuel injection system with inner and outer liners, each having a trapped dual vortex cavity of an exemplary embodiment of the present invention.

Referring now to the drawings in detail, wherein identical numerals indicate the same elements throughout the figures, FIG. 1 depicts an exemplary embodiment of the present invention in a combustor 10 which comprises a hollow body defining a combustion chamber 12 therein. The exemplary combustor 10 is generally annular in form about an axis 14 and is further comprised of an outer liner 16, an inner liner 18, and a dome inlet module designated generally by the numeral 20. A casing 22 is positioned around combustor 10 so that an outer radial passage 24 is formed between casing 22 and outer liner 16 and an inner passage 26 is defined between casing 22 and inner liner 18. The outer and inner liners 16 and 18 are generally shells that are made of sheet metal.

The dome inlet module 20 may be like those shown and disclosed in U.S. Pat. No. 5,619,855 and U.S. patent application Ser. No. 09/215,863, filed Dec. 18, 1998, now U.S. Pat. No. 6,295,801 entitled "Fuel Injector Bar for A Gas Turbine Engine Combustor Having Trapped Vortex Cavity", which are owned by the assignee of the current invention and is hereby incorporated by reference. FIG. 1 depicts combustor 10 as having a dome inlet module 20 which is separate from a diffuser 28 located upstream thereof for directing air flow from an exit end 30 of a compressor. The dome inlet module 20, which is connected to outer liner 16 and inner liner 18, includes an annular outer vane 32, an annular inner vane 34, and one or more annular middle vanes 36 disposed therebetween, and circumferentially distributed radial vanes 35 radially extending between the annular inner, outer, and middle vanes so as to form a plurality of flow passages 38. While three such flow passages are shown in FIG. 1, there may be either more or less depending upon the number of middle vanes 36 provided. Dome inlet module 20 is positioned in substantial alignment with the outlet of diffuser 28 so that a mainstream air flow 37 is directed unimpeded into combustion chamber 12. In addition, it will be seen that outer and inner vanes 32 and 34 extend axially upstream in order to better receive the mainstream air flow within flow passages 38 of dome inlet module 20.

Note that achieving and sustaining combustion in such a high velocity flow is difficult and, likewise, carries downstream into combustion chamber 12 as well. In order to overcome this problem within combustion chamber 12, some means for igniting the fuel/air mixture and stabilizing the flame thereof is required. This is accomplished by the incorporation of a trapped dual vortex outer cavity 40 formed at least in the outer liner 16. A similar trapped dual vortex inner cavity 42 may also be provided in the inner liner 18 as illustrated herein. The trapped dual vortex outer and inner cavities 40 and 42 are utilized to produce trapped dual counter-rotating vortices indicated by top and bottom vortices 31 and 33 of a fuel and air mixture as schematically illustrated in the cavities in FIGS. 1 and 2.

The outer liner 16 and inner liner 18 and the dual trapped vortex outer and inner cavities 40 and 42, respectively, are located immediately downstream of dome inlet module 20 and illustrated as being substantially rectangular in shape (although outer and inner cavities 40 and 42 may be configured as arcuate in cross-section). Each of the outer and inner cavities 40 and 42 is defined between an aft wall 44, a forward wall 46, and a bottom wall 48 formed therebetween which is substantially perpendicular to the aft and forward walls 44, 46, and an opening 41 extending between the aft wall 44 and the forward wall 46 at a top 39 of the cavity and that is open to combustion chamber 12 and spaced apart from the bottom wall 48. In the exemplary embodiment illustrated herein, the outer and inner cavities 40 and 42 are substantially rectangular in cross-section in an axially extending cross-section as illustrated in FIGS. 1-3.

Figure 2:
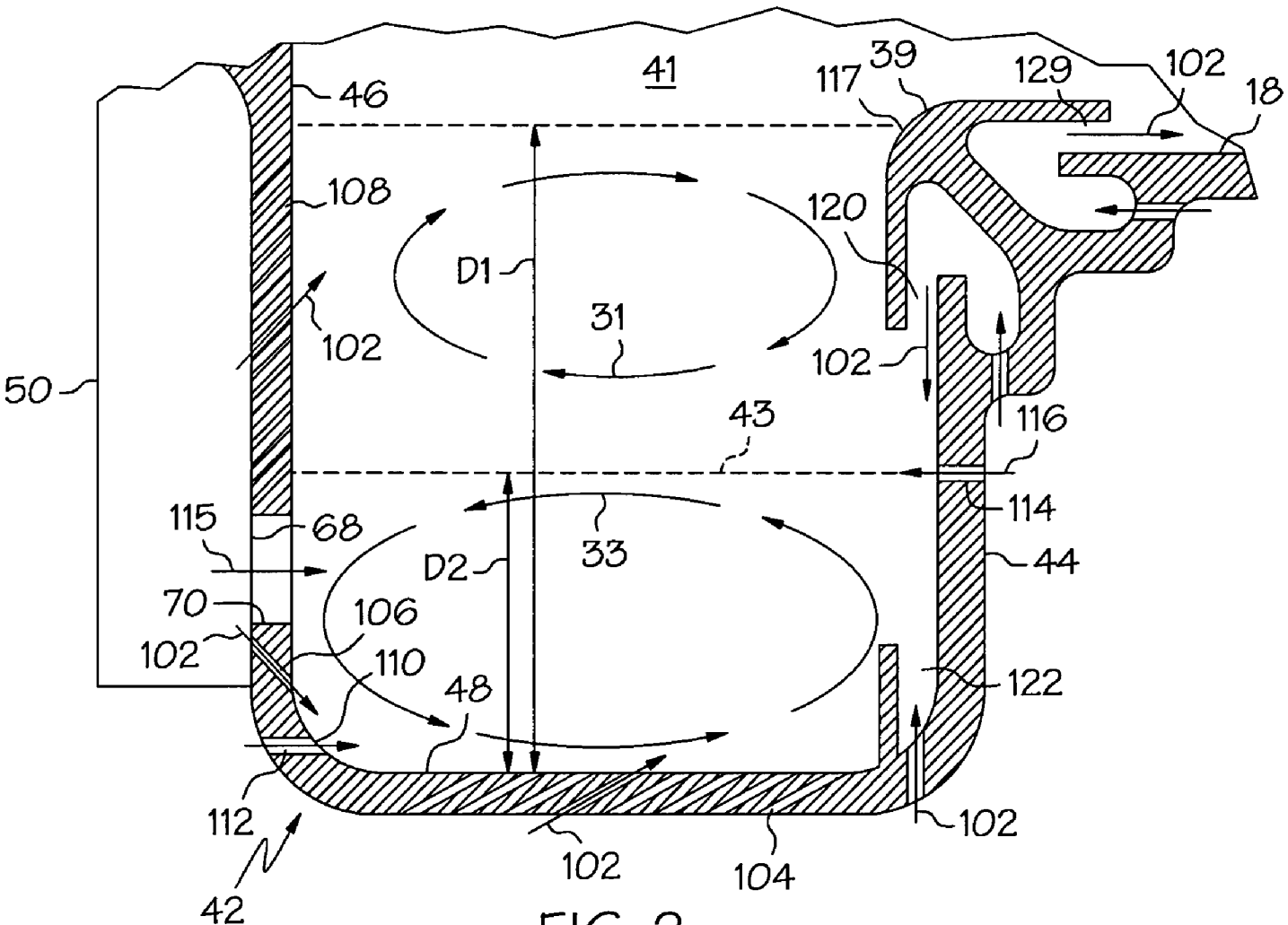
FIG. 2 is an enlarged longitudinal cross-sectional view illustration of the trapped dual vortex cavity in FIG. 1.
Figure 3:
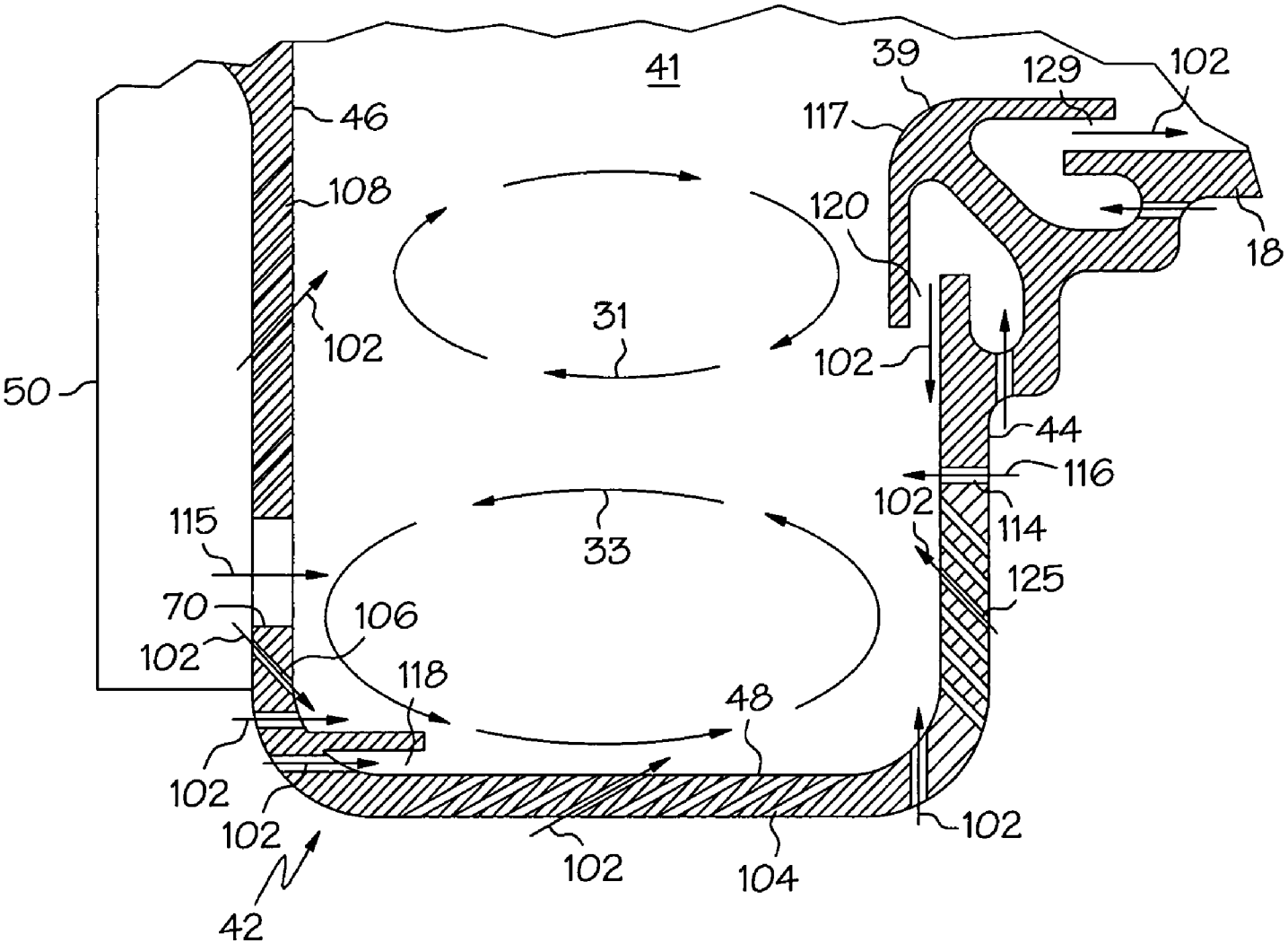
FIG. 3 is an enlarged longitudinal cross-sectional view illustration of an alternative trapped dual vortex cavity.

Referring to FIG. 2 in particular, aftwardly injected air 110 is injected through air injection first holes 112 disposed through the forward walls 46. The air injection first holes 112 are positioned lengthwise along the forward walls as close as possible to the bottom walls 48 to help drive the bottom vortex 33. Vortex driving forwardly injected air 116 is injected through air injection second holes 114 disposed through the aft walls 44. The air injection second holes 114 are positioned lengthwise approximately midway between the bottom walls 48 and the openings 41 at the top 39 of the outer and inner cavities 40 and 42. Here, the term approximately midway for the purpose of this patent is 50% of a first distance D1 from the openings 41 to the bottom wall 48 plus or minus 15% of the first distance. The forwardly injected air 116 also defines an annular boundary 43 between the top and bottom vortices 31 and 33 and top and bottom portions of the outer and inner cavities 40 and 42 for containing the top and bottom vortices 31 and 33.

Figure 4:
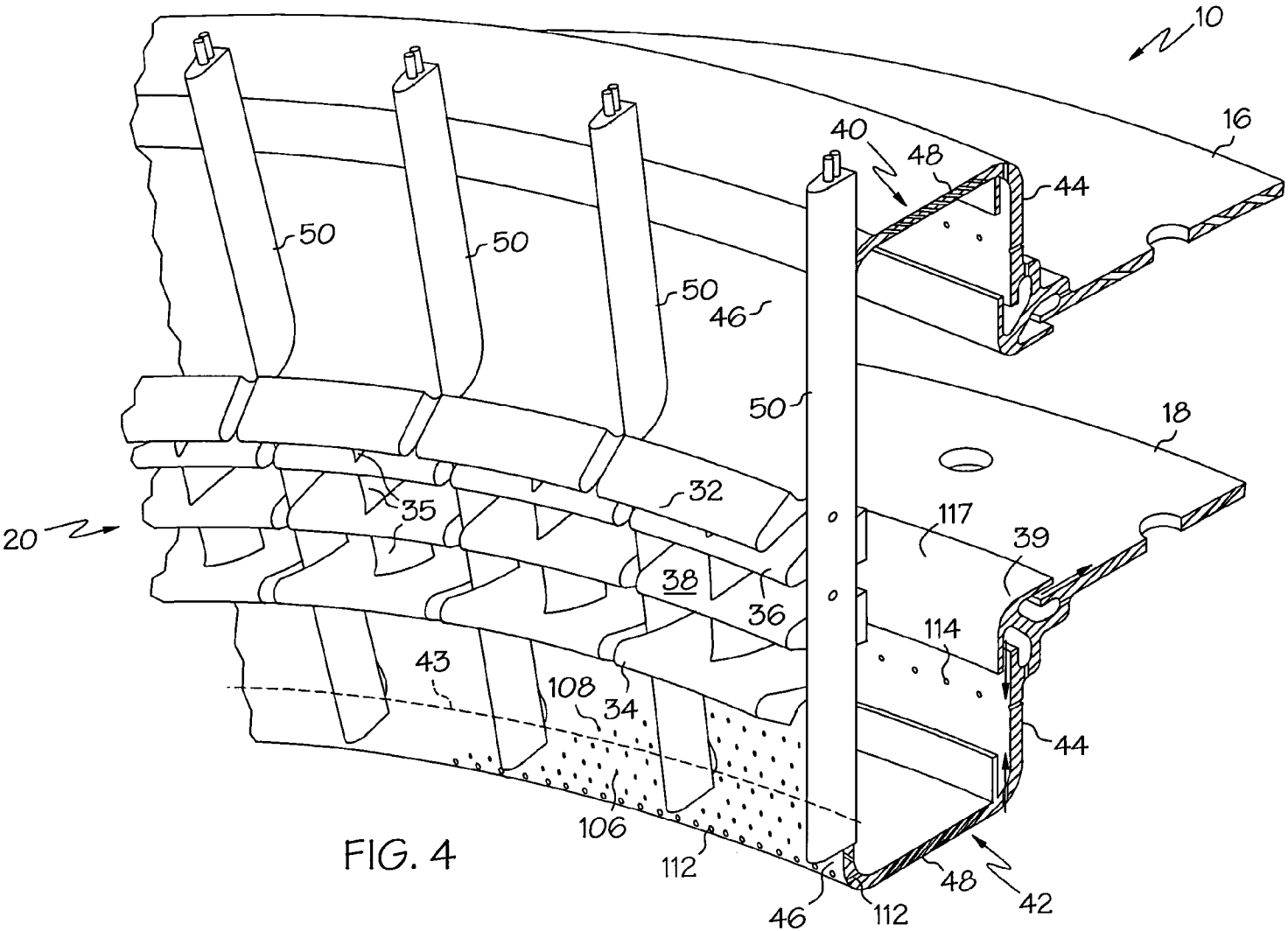
FIG. 4 is a forward looking aft perspective view illustration of the dome inlet module depicted in FIG. 1 and the fuel injector bars.

Fuel 115 is injected through fuel injection holes 70 in the forward walls 46. The fuel injection holes 70 are located approximately midway between the bottom walls 48 and the annular boundary 43 of the cavities 40 and 42. Here, the term approximately midway for the purpose of this patent is 50% of a second distance D2 from the bottom wall 48 to the annular boundary 43 plus or minus 15% of the second distance D2. In the exemplary embodiment of the invention, as illustrated herein, the fuel injection holes 70 in the forward walls 46, the first holes 112 in the forward walls 46, and the second holes 114 in the aft walls 44 are arranged in singular circumferential rows as illustrated in FIGS. 1, 2 and 4. However, other arrangements may be used including more than one row of the fuel to injection holes 70, the first holes 112 and/or the second holes 114.

Film cooling means in the form of cooling apertures, such as holes or slots angled through walls, are well known in the industry for cooling walls in the combustor. In the exemplary embodiment of the present invention illustrated herein, some of the film cooling means are also used to promote and augment the circulatory flow of the top and bottom vortices 31 and 33 in the cavities as well as cool some of the walls. The film cooling apertures within the cavities are angled to flow cooling air 102 in the direction of the vortices nearby. The flow cooling air 102 is air directed from the diffuser 28 that flows around the dome inlet module 20. A plurality of first angled film cooling apertures 104 through the bottom wall 48 are angled away from the forward wall 46 to direct cooling air 102 such that it has a velocity component in a counterclockwise direction of the bottom vortex 33.

Figure 7:
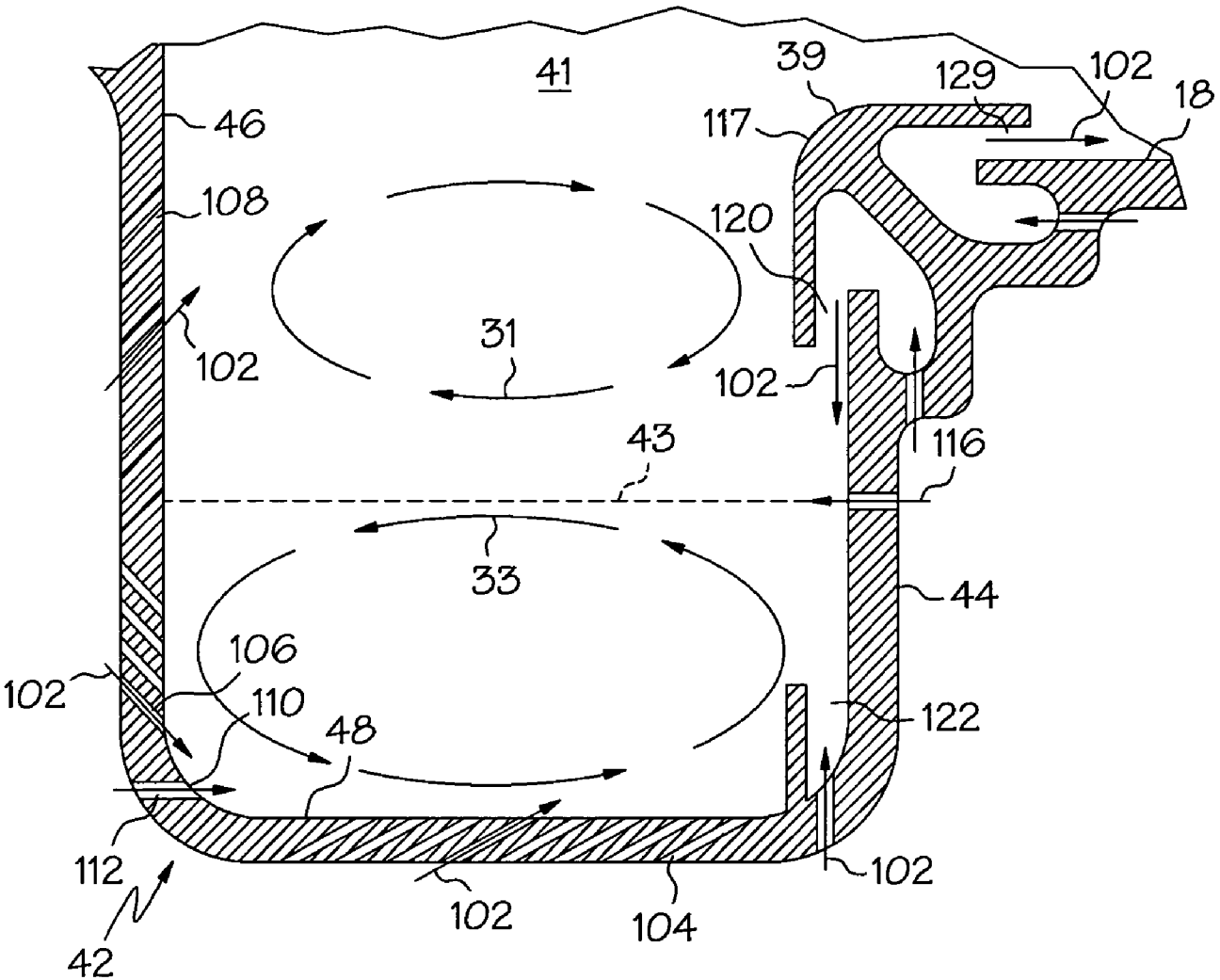
FIG. 7 is an enlarged longitudinal cross-sectional view illustration of the trapped dual vortex cavity in FIG. 1 taken in a different radial plane which does not pass through a fuel injection hole 70 in FIG. 2.

Referring to FIGS. 2 and 7, a plurality of second angled film cooling apertures 106 through the forward wall 46 between the fuel injection holes 70 and the bottom wall 48 are angled towards the bottom wall 48 to direct and flow cooling air 102 such that it has a velocity component in a counterclockwise direction of the bottom vortex 33. A plurality of third angled film cooling apertures 108 through the forward wall 46 between the fuel injection holes 70 and the openings 41 are angled towards the openings to flow and direct cooling air 102 such that it has a velocity component in a clockwise direction of the top vortex 31. FIG. 7 is an enlarged longitudinal cross-sectional view illustration of the trapped dual vortex cavity in FIG. 1 taken in a different radial plane which does not pass through a fuel injection hole 70 in FIG. 2 and shows a larger number of the second angled film cooling apertures 106. FIG. 4 further illustrates an exemplary distribution of the second and third angled film cooling apertures 106 and which are divided by the annular boundary 43 between the top and bottom portions of the outer and inner cavities 40 and 42 containing the top and bottom vortices 31 and 33. The mainstream flow from the flow passages 38 are in the downstream direction and drives the top vortex 31 in the clockwise direction.

In the exemplary embodiment illustrated herein in FIGS. 1-3, the cavities are illustrated having top and bottom cooling slots 120 and 122, respectively, that are parallel to the aft wall and operable to direct and flow cooling air 102 along the aft wall 44. The top cooling slots 120 are part of cooling nuggets 117 which have downstream flow directing film cooling slots 129 for film cooling the outer and inner liners 16 and 18 by directing flow cooling air 102 along the outer and inner liners.

An alternative embodiment of the invention is illustrated in FIG. 3 as incorporating the top cooling slots 120, as part of the cooling nuggets 117, but does not have the bottom cooling slots 122. Bottom wall cooling slots 118 extend from the forward walls 46 and are parallel to the bottom wall 48 and operable to direct and flow cooling air along the bottom wall. The forward and bottom walls 46 and 48 have film cooling apertures, as illustrated in FIG. 2 and discussed above and, which are angled to promote and augment the circulatory flow of the top and bottom vortices 31 and 33 in the cavities as well as cool the walls. The aft walls 44 have fourth angled film cooling apertures 125 through the aft walls that are angled towards the openings 41. The fourth angled film cooling apertures 125 direct and flow cooling air 102 such that the cooling air has a velocity component in a counter-clockwise direction of the bottom vortex 33 so as to promote and augment the circulatory flow of the bottom vortex 33 as well as cool the aft walls 44.

The fuel injection system for the combustor 10 illustrated herein is similar to that found in U.S. patent application Ser. No. 09/215,863, filed Dec. 18, 1998, entitled "Fuel Injector Bar For A Gas Turbine Engine Combustor Having Trapped Vortex Cavity". Fuel is injected into trapped vortex outer and inner cavities 40 and 42 through the fuel injection holes 70 in the forward walls 46 by fuel injection means such as outer and inner fuel injectors 72 and 68 in a plurality of fuel injector bars 50 positioned circumferentially around and interfacing with dome inlet module 20 as illustrated in FIGS. 1 and 2. Other types of fuel injection means that can be used are individual fuel injectors or atomizers shown in the references.

Figure 5:
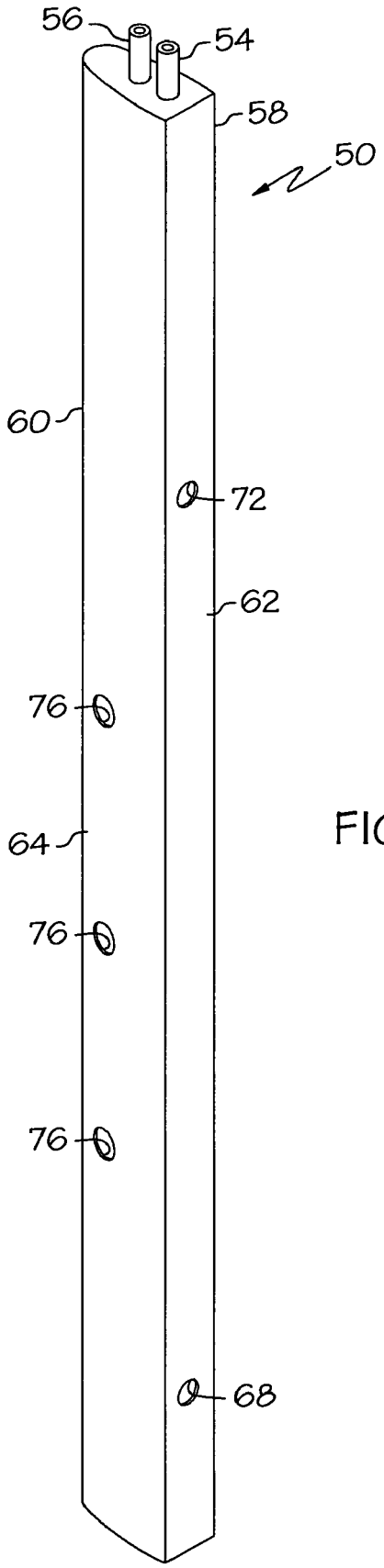
FIG. 5 is an aft perspective view illustration of a single fuel injector bar.
Figure 6:
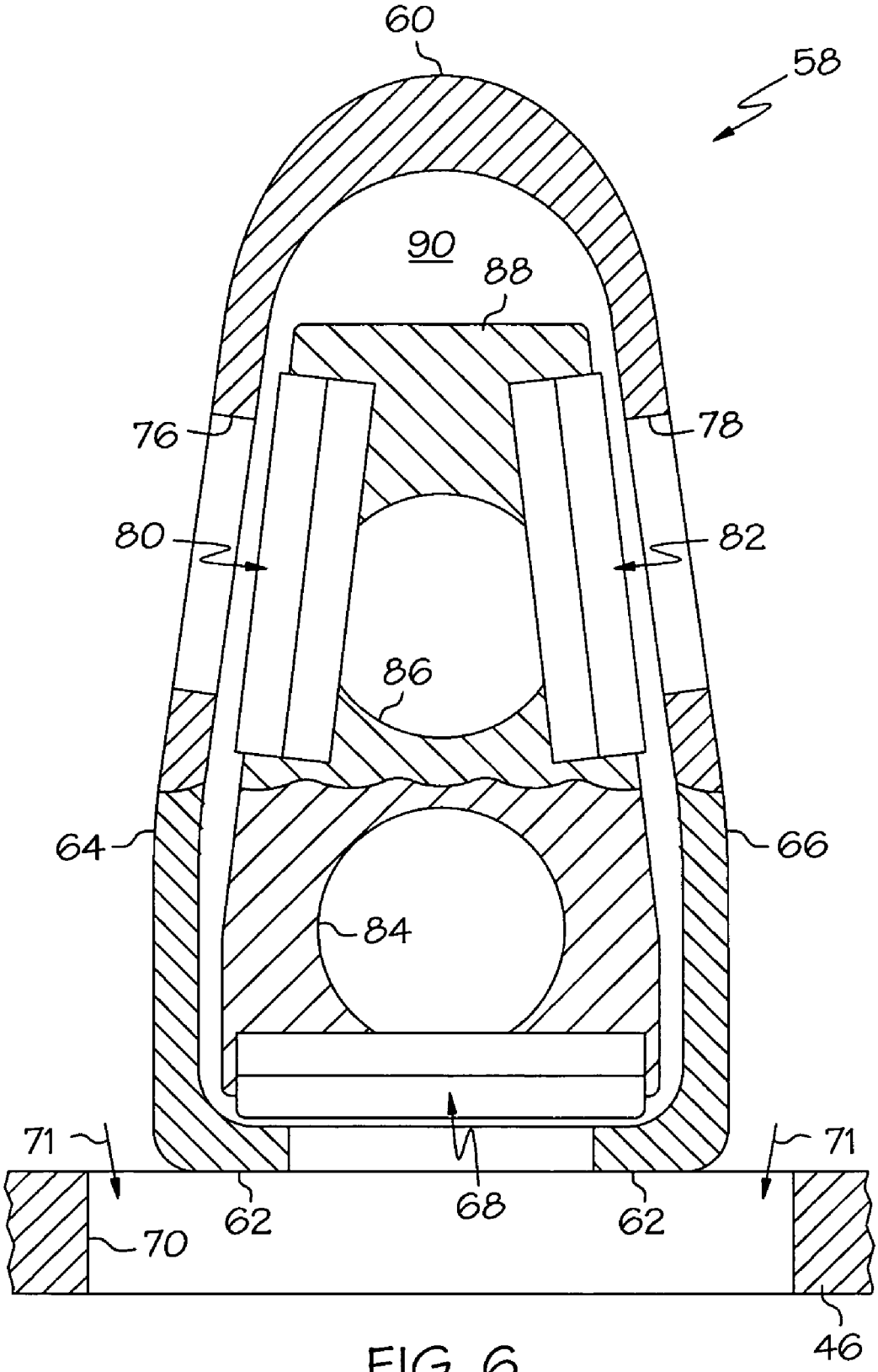
FIG. 6 is a top cross-sectional view illustration of the fuel injector bar depicted in FIG. 5 across two separate planes, whereby, the side injectors and aft injectors are illustrated.

Further referring to FIGS. 4-6, fuel injector bars 50 are configured to be inserted into dome inlet module 20 through engine casing 22 around combustor 10. Each fuel injector bar 50 is disposed in slots provided in annular vanes 32, 34 and 36. Fuel injector bars 50 are in flow communication with a fuel supply 52, via separate fuel lines 54 and 56, in order to inject fuel into cavities 40 and 42 and flow passages 38. The radially outer and inner fuel injectors 72, 68 in the fuel injector bar 50 are aligned within the fuel injection holes 70 in the forward walls 46 of the outer and inner cavities 40 and 42 to inject fuel into the outer and inner cavities. The fuel injectors 68 and the fuel injection holes 70 are located approximately midway between the bottom walls 48 and the annular boundary 43 of the outer and inner cavities 40 and 42. A pair of oppositely disposed fuel holes 76 and 78 in sides 64 and 66, respectively, of the fuel injector bar 50 are provided with injectors 80 and 82 to inject fuel within each flow passage 38 of dome inlet module 20. The fuel bars 50 are circumferentially located in the flow passages 38 between the radial vanes 35. In the exemplary embodiment illustrated herein the fuel bars 50 are circumferentially located midway between the radial vanes 35.

FIGS. 5 and 6 illustrate a body portion 58 of the fuel injector bar 50 which operates as a heat shield to the fuel flowing therethrough to the fuel injectors 68, 72, 80 and 82. Each fuel injector bar 50 has a body portion 58 having an upstream end 60, a downstream end 62, and a pair of sides 64 and 66. The upstream end 60 is aerodynamically shaped while downstream end 62 has, but is not limited to, a bluff surface. Since fuel injectors 68 and 72 are supplied with fuel separately from injectors 80 and 82 via fuel lines 54 and 56, first and second passages 84 and 86 are provided within fuel injector bars 50. Fuel line 54 is brazed to first passage 84 so as to provide flow communication and direct fuel to injectors 68 and 72 while fuel line 56 is brazed to second passage 86 so as to provide flow communication and direct fuel to injectors 80 and 82. It will be understood that injectors 68, 72, 80 and 82 are well known in the art and may be atomizers or other similar means used for fuel injection. The fuel injection holes 70 are wider than the downstream ends 62 of the fuel bars 50 thus allowing combustion air 71 to provide rapid fuel and air mixing. The amount of combustion air 71 allowed to flow through each fuel injection hole 70 is low enough so as not to disturb or interfere with the motion of the dual vortices.

The fuel injector bars 50 are constructed with a middle portion 88 housed within body portion 58 of fuel injection bars 50 and with first and second passages 84 and 86 formed therein. Middle portion 88 is made of ceramic or a similarly insulating material to minimize the heat transferred to the fuel. An additional air gap 90 may also be provided about middle portion 88, where available, in order to further insulate the fuel flowing therethrough. It will be appreciated that middle portion 88 is maintained in position within body portion 58 at least by the attachment of fuel lines 54 and 56 at an upper end thereof.

In operation, combustor 10 utilizes the combustion regions within the outer and inner cavities 40 and 42 as a pilot, with fuel injected through injectors 68 and 72 of fuel injector bars 50. Air is injected into the outer and inner cavities 40 and 42 at strategic locations along the forward and aft walls 46 and 44 to produce the trapped dual counter-rotating top and bottom vortices 31 and 33. The circumferential rows of air injection first holes 112 in the forward walls 46 and the circumferential rows of air injection second holes 114 in the aft walls 44 direct injected air 116 to produce the top and bottom vortices 31 and 33. In this way, dual trapped counter-rotating vortices of fuel and air are formed in the outer and inner cavities 40 and 42. Thereafter, the mixture of fuel and air within outer and inner cavities 40 and 42 are ignited, such as by an igniter 100 positioned adjacent to the outer cavity 40, to combust the fuel/air mixture and form combustion gases therein. These combustion gases then exhaust from outer and inner cavities 40 and 42 across a downstream end of dome inlet module 20 so as to interact with mainstream air and fuel mixture flowing through flow passages 38. It will be understood that if higher power or additional thrust is required, fuel is injected into flow passages 38 of dome inlet module 20 through injectors 80 and 82 of fuel injector bars 50, such fuel being mixed with the mainstream air flowing therethrough. The mixture of fuel and mainstream air is ignited by the cavity combustion gases exhausting across the downstream end of dome inlet module 20. Thus, combustor 10 operates in a dual stage manner depending on the requirements of the engine.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. A gas turbine engine combustor element comprising:

a trapped dual vortex cavity defined between an aft wall, a forward wall, a bottom wall formed therebetween, and a cavity opening at a top of said cavity spaced apart from said bottom wall and extending between said aft wall and said forward wall;

air injection first holes in said forward wall positioned close to said bottom wall;

air injection second holes in said aft wall positioned approximately midway between said bottom wall and said opening at said top of said cavity; and fuel injection holes in said forward wall and located between said air injection second holes and said bottom wall.

2. An element as claimed in claim 1, further comprising first angled film cooling apertures in said bottom wall angled away from said forward wall.

3. An element as claimed in claim 2, further comprising second angled film cooling apertures located in said forward wall between said fuel injection holes and said bottom wall and angled towards said bottom wall and third angled film cooling apertures located in said forward wall between said fuel injection holes and said opening and angled towards said opening.

4. An element as claimed in claim 3, further comprising top and bottom film cooling slots parallel to said aft wall and operable to flow and direct cooling air along said aft wall.

5. An element as claimed as claimed in claim 1, wherein said fuel injection holes, air injection first holes, and air injection second holes, are singularly arranged in circumferential rows.

6. An element as claimed in claim 3, further comprising fourth angled film cooling apertures through said aft wall and located between said air injection second holes in said aft wall and said bottom wall angled towards said opening.

7. An element as claimed in claim 6, further comprising top film cooling slots parallel to said aft wall and operable to flow and direct cooling air along said aft wall and bottom wall cooling slots extending from the forward walls and parallel to said bottom wall and operable to direct and flow cooling air along said bottom wall.

8. A gas turbine engine combustor liner comprising:

a shell having a trapped dual vortex cavity formed therein;

said trapped dual vortex cavity defined between an aft wall, a forward wall, a bottom wall formed therebetween, and a cavity opening at a top of said cavity spaced apart from said bottom wall and extending between said aft wall and said forward wall;

air injection first holes in said forward wall positioned close to said bottom wall;

air injection second holes in said aft wall positioned lengthwise approximately midway between said bottom wall and said opening at said top of said cavity; and fuel injection holes in said forward wall between said air injection second holes and said bottom wall.

9. A liner as claimed in claim 8, further comprising first angled film cooling apertures in said bottom wall angled away from said forward wall.

10. A liner as claimed in claim 9, further comprising second angled film cooling apertures located in said forward wall between said fuel injection holes and said bottom wall and angled towards said bottom wall and third angled film cooling apertures located in said forward wall between said fuel injection holes and said opening and angled towards said opening.

11. A liner as claimed in claim 10, further comprising top and bottom film cooling slots parallel to said aft wall and operable to flow and direct cooling air along said aft wall.

12. A liner as claimed in claim 11, wherein said fuel injection holes, air injection first holes, and air injection second holes, are singularly arranged in circumferential rows.

13. A liner as claimed in claim 10, further comprising fourth angled film cooling apertures disposed through said aft wall and located between said air injection second holes in said aft wall and said bottom wall angled towards said opening.

14. A liner as claimed in claim 13, further comprising a top film cooling slot parallel to said aft wall and operable to flow and direct cooling air along said aft wall and a bottom wall cooling slot extending from said forward wall, parallel to said bottom wall, and operable to direct and flow cooling air along said bottom wall.

15. A gas turbine engine combustor comprising:

an outer liner;

an inner liner spaced from said outer liner, wherein a combustion chamber is defined therebetween;

a dome inlet module having an outer member fixed to said outer liner and an inner member fixed to said inner liner, wherein a plurality of flow passages are defined therebetween for flowing air into said combustion chamber;

means for injecting fuel into said flow passage;

a trapped double vortex outer cavity in said outer liner and positioned immediately downstream of said dome inlet module;

said trapped dual vortex outer cavity defined between an aft wall, a forward wall, a bottom wall formed therebetween, and a cavity opening at a top of said cavity spaced apart from said bottom wall and extending between said aft wall and said forward wall;

an outer plurality of air injection first holes in said forward wall positioned close to said bottom wall;

an outer plurality of air injection second holes in said aft wall positioned lengthwise approximately midway between said bottom wall and said opening at said top of said outer cavity;

an outer plurality of fuel injection holes in said forward wall between said outer plurality of air injection second holes and said bottom wall;

means for injecting fuel into said outer plurality of fuel injection holes; and an igniter positioned adjacent to said trapped vortex cavity for igniting said fuel and air therein to produce pilot combustion gases.

16. A gas turbine engine combustor as claimed in claim 15, further comprising:

a trapped double vortex inner cavity in said inner liner and positioned immediately downstream of said dome inlet module;

said trapped dual vortex inner cavity defined between a second aft wall, a second forward wall, a second bottom wall formed therebetween, and a second cavity opening at a second top of said inner cavity spaced apart from said second bottom wall and extending between said second aft wall and said second forward wall;

an inner plurality of air injection first holes in said forward wall positioned close to said bottom wall;

an inner plurality of air injection second holes in said aft wall positioned lengthwise approximately midway between said bottom wall and said opening at said top of said inner cavity;

an inner plurality of fuel injection holes in said second forward wall between said inner plurality of air injection second holes and second said bottom wall; and means for injecting fuel into said inner pluralities of fuel injection holes.

17. A gas turbine engine combustor as claimed in claim 16, wherein said means for injecting fuel comprises a plurality of fuel injector bars positioned circumferentially around and interfacing with said inlet dome module, each of said fuel injector bars in flow communication with a fuel supply and comprising:

a body portion having an upstream end, a downstream end, and a pair of sides;

a first plurality of injectors located in said body portion and in flow communication with said fuel supply;

radially outer and inner fuel injectors located in said body downstream end and in flow communication with said fuel supply; and said outer and inner fuel injectors aligned and open to said outer and inner plurality of fuel injection holes, respectively.

18. A gas turbine engine combustor as claimed in claim 17, further comprising first angled film cooling apertures in said bottom walls angled away from said forward walls.

19. A gas turbine engine combustor as claimed in claim 18, further comprising second angled film cooling apertures located in said forward walls between said fuel injection holes and said bottom walls and angled towards said bottom wall and third angled film cooling apertures located in said forward walls between said fuel injection holes and said openings and angled towards said openings.

20. A gas turbine engine combustor as claimed in claim 19, wherein said fuel injection holes are wider than said downstream end of said fuel injector bars to allow combustion air to flow around said fuel injector bars and through said fuel injection holes.

21. A gas turbine engine combustor as claimed in claim 19, further comprising top and bottom film cooling slots parallel to said aft wall and operable to flow and direct cooling air along said aft walls.

22. A gas turbine engine combustor as claimed in claim 19, wherein said fuel injection holes, air injection first holes, and air injection second holes, are singularly arranged in circumferential rows.

23. A gas turbine engine combustor as claimed in claim 19, further comprising an annular outer vane, an annular inner vane, and one or more annular middle vanes disposed therebetween, and circumferentially distributed radial vanes radially extending between said annular inner, outer, and middle vanes forming said plurality of flow passages therebetween and said fuel bars are circumferentially located in said flow passages between said radial vanes.

* * * * *